US009302499B2

(12) United States Patent
Yamasaki

(10) Patent No.: US 9,302,499 B2
(45) Date of Patent: Apr. 5, 2016

(54) NAIL PRINT APPARATUS AND PRINTING METHOD THEREOF

(71) Applicant: CASIO COMPUTER CO., LTD., Shibuya-ku, Tokyo (JP)

(72) Inventor: Shuichi Yamasaki, Fussa (JP)

(73) Assignee: Casio Computer Co., Ltd, Tokyo (JP)

( * ) Notice: Subject to any disclaimer, the term of this patent is extended or adjusted under 35 U.S.C. 154(b) by 46 days.

(21) Appl. No.: 14/475,695

(22) Filed: Sep. 3, 2014

(65) Prior Publication Data

US 2015/0062216 A1 Mar. 5, 2015

(30) Foreign Application Priority Data

Sep. 5, 2013 (JP) ..... 2013-183577

(51) Int. Cl.

| | |
|---|---|
| ***B41J 29/38*** | (2006.01) |
| ***B41J 29/393*** | (2006.01) |
| ***B41J 3/407*** | (2006.01) |
| ***B41J 2/49*** | (2006.01) |

(52) U.S. Cl.

CPC . *B41J 3/4073* (2013.01); *B41J 2/49* (2013.01)

(58) Field of Classification Search

CPC ..... B41J 3/4073; B41J 2/49; B41J 2/0458; B41J 2/04541; B41J 2/04581; B41J 29/393; B41J 3/407

USPC ..... 347/9, 14, 19

See application file for complete search history.

(56) References Cited

U.S. PATENT DOCUMENTS

| | | | | |
|---|---|---|---|---|
| 6,286,517 | B1 * | 9/2001 | Weber et al. | 132/73 |
| 2009/0153604 | A1 * | 6/2009 | Chen et al. | 347/9 |
| 2013/0083098 | A1 * | 4/2013 | Yamasaki | 347/5 |

FOREIGN PATENT DOCUMENTS

| | | |
|---|---|---|
| JP | 2003-534083 | 11/2003 |

* cited by examiner

*Primary Examiner* — Jason Uhlenhake

(74) *Attorney, Agent, or Firm* — Amin, Turocy & Watson, LLP

(57) ABSTRACT

A nail print apparatus, including: a print head which performs printing on a nail of a finger or a nail of a toe; an unprinted region detecting unit which detects an unprinted region on which a nail design is not printed in the nail having a printed region on which the nail design is printed, the unprinted region being generated by growth of the nail after the nail design is printed; and a printing control unit which controls the print head to perform printing on the unprinted region.

16 Claims, 10 Drawing Sheets

FIG.4A

518

| CANDIDATE COLOR | PRIORITY ORDER | R | G | B |
|---|---|---|---|---|
| CANDIDATE COLOR 1 | 1 | rv1 | gv1 | bv1 |
| CANDIDATE COLOR 2 | 2 | rv2 | gv2 | bv2 |
| CANDIDATE COLOR 3 | 3 | rv3 | gv3 | bv3 |

FIG.4B

519

| | R | G | B |
|---|---|---|---|
| PRINTING COLOR | rv2 | gv2 | bv2 |

NAIL PRINT APPARATUS AND PRINTING METHOD THEREOF

CROSS-REFERENCE TO RELATED APPLICATIONS

The entire disclosure of Japanese Patent Application No. 2013-183577 filed on Sep. 5, 2013 including description, claims, drawings, and abstract are incorporated herein by reference in its entirety.

BACKGROUND OF THE INVENTION

1. Field of the Invention

The present invention relates to a nail print apparatus and a printing method thereof.

2. Description of Related Art

Conventionally, many women have nail designs on their nails to enjoy the nail designs as fashion.

Such nail designs can be applied at nail salons for nail treatment and also by the users themselves at home. Nail print apparatuses which are printing devices for automatically printing nail designs are also known. Such nail print apparatus is described in Japanese Unexamined Patent Application Publication No. 2003-534083, for example.

However, nails grow every day. Thus, when approximate one week has elapsed since a nail design was applied, there is no nail design on the growing portions near the bases of nails, exposing natural nails.

In such case, the nail design can remain beautiful if the nail design is removed every time the nails have grown.

However, in a case in which the nail design applied to the nails is favorable, for example, the user possibly wishes to have the nail design on the nails as long as possible even when the nails have grown. Furthermore, when the nail design is applied again at a nail salon every time the nails have grown, the cost increases.

Thus, there is a desire to make a nail design applied to the nails last as long as possible.

Thus, for example, the user himself/herself repairs the nail design by applying ink only to the regions where the nail design is not printed, the regions being generated by the nail growth in some cases.

However, since various colors are used for nail designs, it has been difficult for a user to select an appropriate color to obscure the regions where the nail design is not printed, the regions being generated by the nail growth.

Furthermore, since the regions generated by the nail growth are comparatively narrow in general, it has been difficult for a user to repair the nail design by applying ink to the narrow regions.

Thus, the user needs to narrow down, from the start, the choice of design selection by selecting a nail design which obscures the growing portions when the nails have grown or leave the growing portions of nails without the nail design.

SUMMARY OF THE INVENTION

An object of the present invention is to provide a nail print apparatus and a printing method thereof which can make a nail design last long by obscuring growing portions of nails after applying the nail design thereto.

In order to solve the above object, according to one aspect of the present invention, there is provided a nail print apparatus, including: a print head which performs printing on a nail of a finger or a nail of a toe; an unprinted region detecting unit which detects an unprinted region on which a nail design is not printed in the nail having a printed region on which the nail design is printed, the unprinted region being generated by growth of the nail after the nail design is printed; and a printing control unit which controls the print head to perform printing on the unprinted region.

According to another aspect of the present invention, there is provided a printing method of a nail print apparatus, including: detecting an unprinted region on which a nail design is not printed in a nail of a finger or a nail of a toe having a printed region on which the nail design is printed, the unprinted region being generated by growth of the nail after the nail design is printed; and printing on the unprinted region.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein:

FIG. 4A is a view showing an example of a candidate color register in FIG. 3;

FIG. 4B is a view showing an example of a printing color register in FIG. 3;

DETAILED DESCRIPTION OF THE PREFERRED EMBODIMENT

Hereinafter, an embodiment of a nail print apparatus according to the present invention will be described in detail with reference to the drawings.

Though the after-mentioned embodiment is provided with various technically preferred limitations to perform the present invention, the scope of the present invention is not limited to the following embodiment and illustrated examples.

In the following embodiment, the printing target is fingernails of hands. However, the printing target of the present invention is not limited to the fingernails of hands, and printing may be performed on nails of toes.

Figure 1:
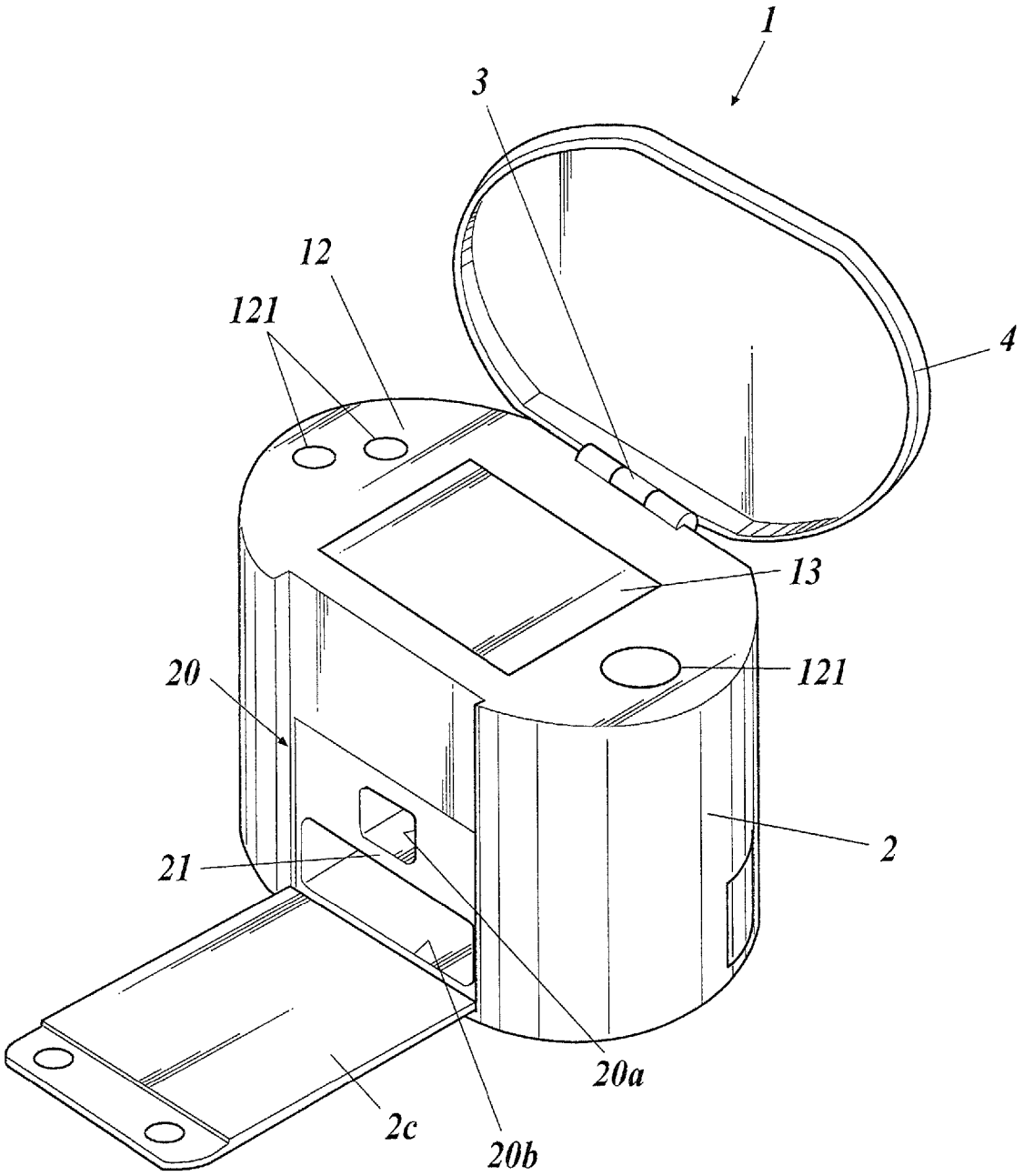
FIG. 1 is a perspective view conceptually showing a nail print apparatus according to an embodiment which shows a state in which a cover is open.

FIG. 1 is a perspective view showing an outer appearance of the nail print apparatus in the embodiment.

As shown in FIG. 1, the nail print apparatus 1 includes a case main body 2 and a cover 4.

The cover 4 is connected to the case main body 2 so as to be rotatable via a hinge 3 provided at a rear end portion on the upper surface (top plate) of the case main body 2.

The cover 4 is rotatable from a state of lying on the top plate of the case main body 2 to a state (see FIG. 1) of being vertically provided with respect to the top plate of the case main body 2 with the hinge 3 as the supporting point.

The case main body 2 is formed in a nearly oval shape in a plan view from above.

An opening/closing plate 2*c* is provided at the front side of the case main body 2 so as to be able to flip up and down.

The opening/closing plate 2*c* is joined to the case main body 2 via a hinge (not shown in the drawings) which is provided at the lower end portion of the front surface of the case main body 2. The opening/closing plate 2*c* is for opening and closing the front surface of the case main body 2.

The shapes and configurations of the case main body 2 and the cover 4 are not limited to the examples illustrated here.

An operation unit 12 is set on the upper surface (top plate) of the case main body 2.

The operation unit 12 is for performing various types of input by a user.

The operation unit 12 is provided with a power switch button to turn on the nail print apparatus 1, a stop switch button to stop an operation, a design selection button to select a design image to be printed on a nail T, a print start button to instruct to start printing, a photography start button to instruct start of photography and operation buttons 121 for performing various types of input, for example.

In the embodiment, the operation unit 12 includes a touch panel-type input unit 122 (see FIG. 3) provided on an after-mentioned display unit 13.

In the embodiment, the nail print apparatus 1 is configured so that a nail repair mode can be selected in addition to a nail print mode for printing an image (nail design) on a surface of a nail T of a printing finger U1.

In the nail repair mode, as described later, in a case in which a nail design has been already printed on the nail T, a color blending with a printed region Car (see FIG. 5A, for example) on which the nail design is printed is printed on an unprinted region Nar (natural nail portion on which the nail design is not printed, see FIG. 5A, for example) which is generated by the growth of nail T when time elapses after printing the nail design.

The operation unit 12 is provided with a mode selecting button for selecting one of the modes to perform printing.

In the embodiment, when the printing start button or the photography start button is merely operated, the nail print mode is selected. When the nail repair mode button is operated, the nail repair mode is selected. Thus, the printing start button, the photography start button and the nail repair mode button function as the mode selecting button. The configuration of mode selection button is not limited to the example described here.

In the embodiment, an after-mentioned printing color setting unit 515 selects a plurality of candidate colors for the printing color. The user can input and instruct a color to be printed among the candidate colors by operating the operation unit 12.

The method for inputting and instructing the printing color with the operation unit 12 is not especially limited.

For example, the plurality of candidate colors may be displayed on the display unit 13 one by one in order of priority so that the user operates an OK button to select one of the candidate colors. Alternatively, one of the candidate colors may be selected by displaying the plurality of candidate colors on the display unit 13 and touching the touch panel-type input unit 122.

The display unit 13 is set at a nearly central portion of the upper surface (top plate) of the case main body 2.

The display unit 13 is configured by including a liquid crystal display (LCD), an organic electroluminescent display or other flat display, for example.

In the embodiment, the display unit 13 appropriately displays a nail image (that is, an image of printing finger U1 including an image of nail T) that is an image of the nail T of the printing finger U1, an after-mentioned unprinted region confirmation screen on which only the unprinted region Nar is colored so as to identify the outline of the unprinted region Nar of nail T, a printing color confirmation screen (see FIG. 10) for confirming a color to be printed on the unprinted region Nar, a design selection screen for selecting a design image to be printed on the nail T, thumbnail images for design confirmation, instruction screens for displaying various instructions, a notification screen and an alarm screen, for example.

A touch panel-type input unit 122 (see FIG. 3) is integrally formed on the surface of the display unit 13 in the embodiment. The touch panel-type input unit 122 is configured so that various types of input can be carried out by a touching operation of touching the surface of the display unit 13 with a fingertip or an inputting member such as a stylus pen, for example, and functions as the operation unit 12. It is not essential to integrally configure the touch panel-type input unit 122 on the display unit 13 and the touch panel-type input unit 122 may not be provided.

Figure 2:
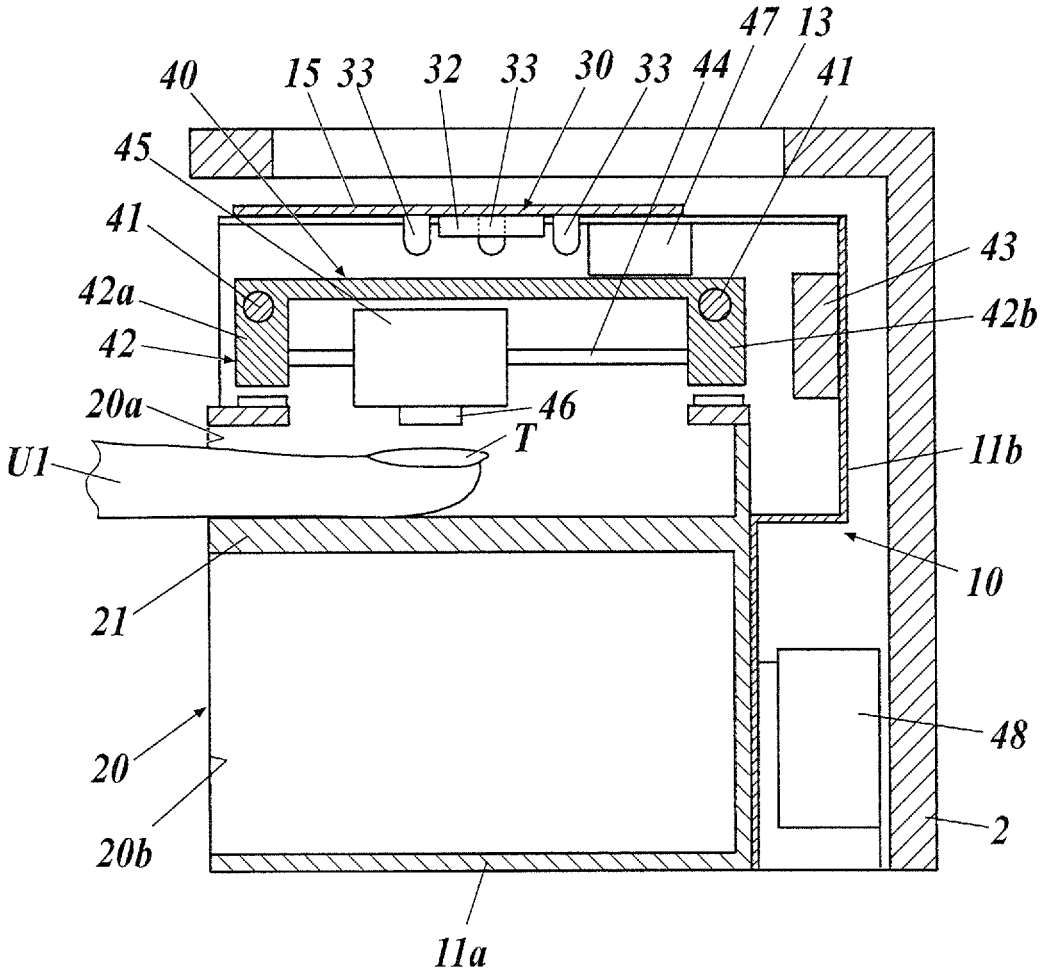
FIG. 2 is a sectional view of main parts in the nail print apparatus of FIG. 1.

FIG. 2 is a sectional view of main parts in the nail print apparatus 1.

As shown in FIG. 2, an apparatus main body 10 of the nail print apparatus 1 is contained in the case main body 2.

The apparatus main body 10 is formed in a nearly box shape. The apparatus main body 10 includes a lower machine casing 11*a* which is set at the lower section in the case main body 2 and an upper machine casing 11*b* which is set above the lower machine casing 11*a* and at the upper section in the case main body 2.

The lower machine casing 11*a* and the upper machine casing 11*b* are provided with a printing finger fixing unit 20, a photographing unit 30, a printing unit 40, a control device 50 (see FIG. 3) and such like.

The printing finger fixing unit 20 is provided in the lower machine casing 11*a*.

That is, the lower machine casing 11*a* is provided with a printing finger inserting unit 20*a* and a non-printing finger inserting unit 20*b* which form the printing finger fixing unit 20.

The printing finger inserting unit 20*a* is divided from the non-printing finger inserting unit 20*b* by a dividing wall 21.

The printing finger inserting unit 20*a* is a finger inserting unit for inserting a finger (hereinafter, called "printing finger U1") corresponding to a nail T which is a target of printing.

The bottom surface of the printing finger inserting unit 20*a* (upper surface of the dividing wall 21 in the embodiment) functions as a finger placement unit (printing finger placement surface) to place the printing finger U1.

Photographing, printing and such like is performed for the printing finger U1 while the printing finger U1 is placed on the printing finger placement surface (upper surface of the dividing wall 21) of the printing finger inserting unit 20*a* as the finger placement unit.

In the embodiment, a case in which a printing finger U1 is inserted into the printing finger inserting unit 20*a* one by one to perform printing on the nail T is described as an example.

Though the shape, size and such like of the printing finger inserting unit 20*a* are not especially limited, the printing finger inserting unit 20*a* is formed in a shape and size that are not tight even when an adult thumb or such like is inserted so as to treat various types of fingers.

The non-printing finger inserting unit 20*b* is a finger inserting unit for inserting fingers (not shown in the drawings. hereinafter, called "non-printing fingers") other than the printing finger U1.

In the embodiment, by inserting the printing finger U1 into the printing finger inserting unit 20*a*, inserting the non-printing fingers into the non-printing finger inserting unit 20*b* and sandwiching the dividing wall 21 between the printing finger U1 and the non-printing fingers, the printing finger U1 is fixed in a stable condition.

For example, in a case in which the thumb is the printing finger U1, the thumb (printing finger U1) is inserted into the printing finger inserting unit 20*a* and the four fingers (index finger, middle finger, ring finger and little finger) other than the thumb are inserted into the non-printing finger inserting unit 20*b*. In this case, by the user sandwiching the dividing wall 21 between the printing finger U1 and the non-printing fingers, the printing finger U1 is fixed.

As for the end portion of the dividing wall 21 from where the finger is inserted, the preferable cross-sectional shape in the finger inserting direction of the end portion of the dividing wall 21 is a circle, an oval, a polygon and such like which is naturally fitted when contacting the bases of the printing finger U1 and the non-printing fingers so as not to strain the bases of the fingers even when the dividing wall 21 is held firmly between the printing finger U1 and the non-printing fingers.

As shown in FIG. 2, the photographing unit 30 is provided on the upper machine casing 11*b*.

That is, a substrate 15 is set on the upper machine casing 11*b*, and a camera 32 as a photographing device is set at the central portion of the lower surface of the substrate 15. It is preferable that the camera 32 has approximately two million pixels or more, for example.

The camera 32 photographs the nail T of the printing finger U1 inserted into the printing finger inserting unit 20*a* to obtain a nail image (that is, the image of printing finger U1 including the image of nail T) which is an image of the nail T of the printing finger U1.

On the substrate 15, lights 33 such as white LEDs are set so as to surround the camera 32. The lights 33 illuminate the nail T of the printing finger U1 at photographing by the camera 32. The photographing unit 30 is configured by including the camera 32 and the lights 33.

In the embodiment, an after-mentioned nail outline detecting unit 512 detects outlines of the nail T (shape of nail T) and the unprinted region Nar on the basis of the nail image obtained by the camera 32 as a photographing device.

A printed region information obtaining unit 514 cuts out an image of the printed region Car from the nail image to obtain design information such colors used in the printed region Car and shape (outline) information of the printed region Car.

Figure 3:
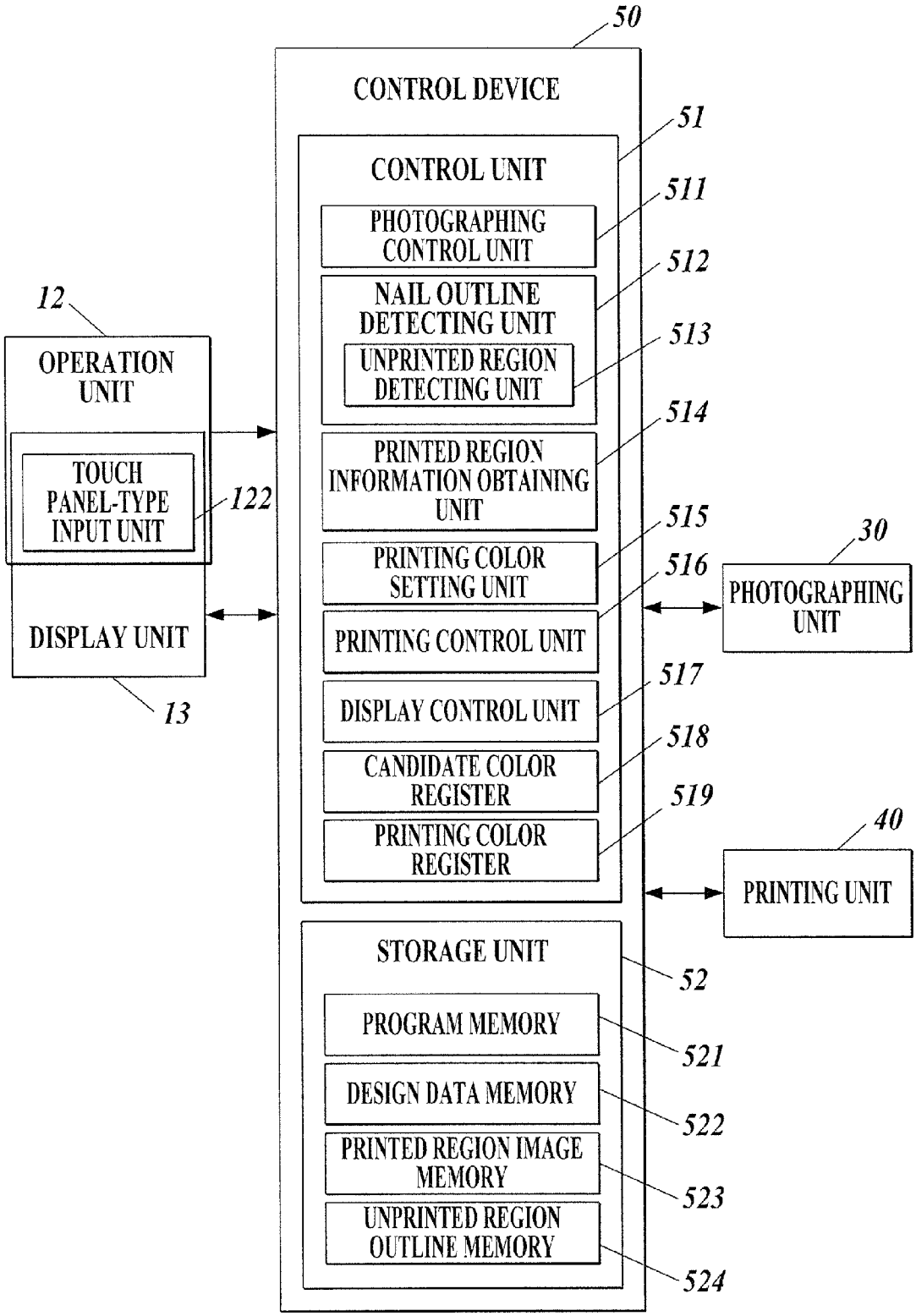
FIG. 3 is a main part block diagram showing a control structure of the nail print apparatus according to the embodiment.

The image data of nail image obtained by the camera 32 may be stored in an after-mentioned storage unit 52 (see FIG. 3).

The photographing unit 30 is connected to an after-mentioned photographing control unit 511 (see FIG. 3) of the control device 50 and controlled by the photographing control unit 511.

The printing unit 40 is mainly provided in the upper machine casing 11*b*.

That is, two guide rods 41 are bridged in parallel to each other between the both side boards of the upper machine casing 11*b*. A main carriage 42 is slidably set at the guide rods 41.

Two guide rods 44 (FIG. 2 shows only the guide rod 44 at the front side) are bridged in parallel to each other between a front wall 42*a* and a rear wall 42*b* of the main carriage 42.

A secondary carriage 45 is slidably set at the guide rods 44. Print heads 46 are mounted on the lower surface of the secondary carriage 45.

In the embodiment, each of the print heads 46 is an ink jet type print head which makes ink be in the form of micro droplets and directly sprays the ink droplets onto a printing surface which is a target of printing to perform printing.

The recording method of the print heads 46 is not limited to the ink jet type.

In the embodiment, the printing unit 40 is provided with the print heads 46 corresponding to ink of yellow (Y), magenta (M) and cyan (C), respectively, for example.

Each of the print heads 46 includes a nozzle array formed of a plurality of nozzles spraying ink of its color.

The print heads 46 provided in the printing unit 40 are not limited to the print heads 46 spraying ink of the three colors. A print head 46 spraying ink of another color may be further provided.

The print heads 46 perform printing on the nail T of printing finger U1 on the basis of nail information detected by an after-mentioned nail outline detecting unit 512 or the like.

In the embodiment, the print heads 46 print an image (nail design) on the surface of the nail T of the printing finger U1 if the nail printing mode is selected. If the nail repair mode is selected, the print heads 46 print a color blending with the printed region Car on which the nail design is printed on the unprinted region Nar (natural nail portion on which the nail design is not printed) generated by the growth of nail T.

Ink cartridges 48 for supplying ink to the print heads 46 are provided in the lower machine casing 11*a*.

The ink cartridges 48 are connected to the print heads 46 via an ink supply tube (not shown in the drawings) to appropriately supply ink to the print heads 46 via the ink supply tube.

The configuration may be such that the ink cartridges are mounted on the print heads 46 themselves.

The main carriage 42 is joined to a motor 43 via a power transmission unit (not shown in the drawings) and is configured to move to the left and right (width direction of the nail print apparatus 1) of the nail print apparatus 1 along the guide rods 41 by the forward-reverse rotation of the motor 43.

The secondary carriage 45 is joined to a motor 47 via a power transmission unit (not shown in the drawings) and is configured to move back and forth (left and right in FIG. 2) of the nail print apparatus 1 along the guide rods 44 by the forward-reverse rotation of the motor 47.

The printing unit 40 is configured by including the guide rods 41, the main carriage 42, the motor 43, the guide rods 44, the secondary carriage 45, the print heads 46, the motor 47, the ink cartridges 48 and others. The motor 43, the print heads 46 and the motor 47 of the printing unit 40 are connected to an after-mentioned printing control unit 516 (see FIG. 3) of the control device 50 and controlled by the printing control unit 516.

The control device 50 is set on the substrate 15 disposed on the upper machine casing 11*b*, for example.

FIG. 3 is a main part block diagram showing a control structure in the embodiment.

As shown in FIG. 3, the control device 50 is a computer which includes a control unit 51 having a CPU (Central Processing Unit) and such like and a storage unit 52 having a ROM (Read only memory), a RAM (Random access memory) and such like which are not shown in the drawings.

The storage unit 52 includes a program memory 521, a design data memory 522, a printed region image memory 523 and an unprinted region outline memory 524.

The program memory 521 is for storing various programs for operating the nail print apparatus 1.

In the embodiment, for example, various programs such as a nail outline detecting program for detecting the nail outline of nail T, a printed region cutting out program for cutting out the printed region Car from the nail image, a design information obtaining program for obtaining the design information such as colors used for the printed region Car, an unprinted region outline detecting program for detecting the outline of unprinted region Nar in the nail T, a printing color selecting program for selecting the printing color and a printing program for printing processing are stored in the program memory 521. The control device 50 executes the programs to control the units of the nail print apparatus 1.

The design data memory 522 is for storing the image data of nail design printed on the nail T.

The image data of nail design stored in the design data memory 522 is, for example, rectangular data which is larger than the general size of nail T so as to handle the various sizes of nail T.

The printed region image memory 523 is for storing an image of printed region Car when an after-mentioned printed region information obtaining unit 514 cuts out the image of printed region Car from the nail image obtained by the photographing unit 30.

As described later, the printed region information obtaining unit 514 obtains design information such as colors used in the printed region Car and outline information of the printed region Car from the image of printed region Car.

The design information such as colors used in the printed region Car, the outline information of the printed region Car and such like may be stored in the storage unit 52 in addition to the printed region image memory 523.

The unprinted region outline memory 524 is for storing the outline of unprinted region Nar when an after-mentioned unprinted region detecting unit 513 of the nail outline detecting unit 512 detects the outline of unprinted region Nar on the basis of the nail image obtained by the photographing unit 30.

The outline of the unprinted region Nar is defined by a border HL between a base of nail T and a flesh portion of finger and a border BL between the unprinted region Nar of nail T and the printed region Car (see FIG. 5A), for example.

The outline of unprinted region Nar is represented by x and y coordinates for the positions of a plurality of points (border line formed as a series of points) forming the outline of unprinted region Nar, for example.

The nail outline detecting unit 512 detects the outline (nail shape) of the entire nail T in the embodiment, and the outline information of the entire nail T may also be stored in the storage unit 52.

In a functional view, the control unit 51 includes functional units such as the photographing control unit 511, the nail outline detecting unit 512, the printed region information obtaining unit 514, the printing color setting unit 515, the printing control unit 516, the display control unit 517 and such like.

The functions as the photographing control unit 511, the nail outline detecting unit 512, the printed region information obtaining unit 514, the printing color setting unit 515, the printing control unit 516, the display control unit 517 and such like are achieved in cooperation between the CPU of the control unit 51 and the programs stored in the ROM and such like of the storage unit 52. The functional units included in the control unit 51 are not limited to the above examples.

The control unit 51 includes a candidate color register 518 and a printing color register 519.

The candidate color register 518 is for storing candidate colors when the printing color setting unit 515 selects the candidate colors from colors of the printed region Car obtained by the printed region information obtaining unit 514.

As described later, when selecting a plurality of candidate colors by a plurality of methods, the printing color setting unit 515 in the embodiment sets a predetermined priority order to the candidate colors, and the candidate colors are stored in the candidate color register 518 together with the respective priority orders. The predetermined priority order may be set as default in advance or a user may arbitrarily set the priority order.

FIG. 4A is a view showing an example of the candidate color register 518.

As shown in FIG. 4A, each of the candidate colors stored in the candidate color register 518 is stored as values of RGB components forming the color.

With respect to the image obtained by the camera 32 (image of printed region Car cut out from the nail image obtained by the camera 32), the color information is represented by the values of RGB components, and in the embodiment, the values of RGB components are stored as the values representing the candidate color.

Each of the colors represented by the values of RGB components is converted into the values of CMY components which can be reproduced by ink included in the print heads 46 by the printing control unit 516 during printing.

FIG. 4A shows an example in which a candidate color 1, a candidate color 2 and a candidate color 3 are stored in the candidate color register 518 with the respective priority orders, the candidate color 1 having RGB component values of rv1, gv1 and bv1, the candidate color 2 having RGB component values of rv2, gv2 and bv2, the candidate color 3 having RGB component values of rv3, gv3 and bv3.

The RGB component values representing the candidate colors may be stored in the candidate color register 518 after being converted into the CMY component values. In such case, the respective values of C, M and Y are stored in the candidate color register 518.

When the nail print apparatus 1 uses ink of four or more colors including LM (light magenta), LC (light cyan) or such like in addition to the three colors of C, M and Y, the values corresponding to colors of ink including LM (light magenta), LC (light cyan) or such like in addition to C, M and Y are stored in the candidate color register 518.

The printing color register 519 is for storing a printing color when the printing color to be printed on the unprinted region Nar in the nail T is selected from the candidate colors and set by the printing color setting unit 515.

FIG. 4B is a view showing an example of the printing color register 519.

FIG. 4B shows an example in which the candidate color 2 having the RGB component values of rv2, gv2 and bv2 is set as the printing color and stored in the printing color register 519.

FIG. 4B shows a case in which the printing color is stored as the RGB component values forming the printing color similarly to the candidate color. The printing color may be represented by such RGB component values, and the RGB component values may be converted into the CMY component values and stored in the printing color register 519.

The photographing control unit 511 controls the photographing unit 30 to photograph the printing finger U1 of the user with the camera 32 and obtains the nail image (that is, image of printing finger U1 including the image of nail T).

In the embodiment, both in the nail print mode and the nail repair mode, when the printing finger U1 of the user is set in the printing finger inserting unit 20*a* and the photography start button of the operation unit 12 is operated, the photographing control unit 511 makes the photographing unit 30 photograph the printing finger U1 including the nail T to obtain the nail image before starting the printing operation.

The image data of nail image obtained by the photography may be stored in the storage unit 52.

The nail outline detecting unit 512 detects the outline of nail T (hereinafter, called "nail outline" or "nail shape") of the printing finger U1 on the basis of the nail image obtained by the camera 32 which is the photographing device.

Specifically, when the nail print mode (that is, the mode for printing the image (nail design) on the surface of nail T of the printing finger U1) is selected, the nail outline detecting unit 512 detects the nail outline (nail shape) from the nail image of nail T in the printing finger U1 obtained by the camera 32, and obtains the nail outline as position information represented by x and y coordinates and such like.

As the method for detecting the nail outline (nail shape) by the nail outline detecting unit 512, for example, the nail outline (nail shape) is detected from the nail image of nail T of the printing finger U1 obtained by the camera 32 on the basis of the difference in color between the nail T and the other finger portion.

The method for detecting the nail outline (nail shape) by the nail outline detecting unit 512 is not limited to the example illustrated here and various methods for detecting outline can be applied.

The nail outline as the detection result by the nail outline detecting unit 512 may be stored in the storage unit 52.

The nail outline detecting unit 512 is not limited to the nail outline detecting unit which detects only the outline (shape of the nail T) of the nail T as the nail information.

For example, the nail outline detecting unit 512 may also detect the height of nail T (position in vertical direction of the nail T) and the curvature of nail T (nail curvature). In this case, a plurality of nail images are obtained by photographing the nail T of the printing finger U1 with the camera 32 from a plurality of different angles, and the height and curvature of the nail T are detected on the basis of the obtained nail images, for example.

In a case in which the nail outline detecting unit 512 also detects the height of nail T and the curvature of nail T, printing can be performed also in consideration of the shape of the nail T in the height direction, which can achieve more accurate printing.

The nail outline detecting unit 512 includes the unprinted region detecting unit 513 which detects the unprinted region Nar of nail T when the nail repair mode is selected, the nail repair mode being a mode for printing a color blending with the printed region Car on which the nail design is printed on the unprinted region Nar (natural nail portion on which the nail design is not printed) generated by the growth of nail T in a case in which the nail design has been already printed on the nail T.

In the embodiment, the nail repair mode is for repairing the nail design by printing a color on the natural nail portion generated by the growth of nail T as mentioned above. Thus, the unprinted region Nar does not mean the entire region of nail T which is not colored, but means the unprinted region which is a portion of nail T that has newly grown.

That is, in the embodiment, the unprinted region Nar in nail T detected by the unprinted region detecting unit 513 is the region on which printing is not performed and which is located from the border HL between the base of nail T and the flesh portion of finger to the border BL between the unprinted region Nar and the printed region Car of nail T.

Here, the nail T grows for approximately 0.1 mm per day in general. Thus, when ten days or the like elapses after the nail design is applied to the nail T, the unprinted region Nar having a width of approximately 1 mm is generated at the base side of nail T.

The unprinted region detecting unit 513 first detects the border HL between the base of nail T and the flesh portion of finger, for example.

Then, the unprinted region detecting unit 513 detects a line where the color or brightness largely changes when a line having the same shape as the border HL is moving toward the distal end of nail T. The detected line is the border BL between the unprinted region Nar and the printed region Car.

The unprinted region detecting unit 513 detects, as the unprinted region Nar, the region defined by the border HL between the base of nail T and flesh portion of finger and the border BL between the unprinted region Nar and the printed region Car.

The method for detecting the outline of unprinted region Nar by the unprinted region detecting unit 513 is not limited to the above example and various methods for detecting outline can be applied.

For example, when an after-mentioned printed region information obtaining unit 514 detects the outline of printed region Car, the unprinted region detecting unit 513 may detect, as the unprinted region Nar, a region excluding the region defined by the outline of printed region Car being detected by the printed region information obtaining unit 514 from a region defined by the nail outline (outline of the entire nail T) being detected by the nail outline detecting unit 512.

The unprinted region detecting unit 513 stores the outline of unprinted region Nar (that is, the border HL between the base of nail T and flesh portion of finger and the border BL between the unprinted region Nar and the printed region Car) in the unprinted region outline memory 524.

The outline of unprinted region Nar is represented by x and y coordinates of positions of a plurality of points (border line as a series of points) forming the outline of unprinted region Nar, for example.

In the nail repair mode, the printed region information obtaining unit 514 obtains information of the nail design part (that is, printed region Car) which is already printed on nail T.

The printed region information obtaining unit 514 distinguishes between the printed region Car and the other region by the difference in color or brightness in the nail image obtained by the camera 32 and cuts out the image of printed region Car.

The method for cutting out the image of printed region Car by the printed region information obtaining unit 514 is not especially limited.

The image of printed region Car cut out by the printed region information obtaining unit 514 is stored in the printed region image memory 523.

In the embodiment, the printed region information obtaining unit 514 obtains design information such as a color used in the nail design which has been already printed on the nail T.

Specifically, the printed region information obtaining unit 514 obtains RGB component values of colors used in the nail design from the image of printed region Car stored in the printed region image memory 523.

In the embodiment, the printed region information obtaining unit 514 obtains areas of regions where the respective colors are used in the printed region Car.

Further, the printed region information obtaining unit 514 may obtain the outline information of printed region Car represented by x and y coordinates of positions of a plurality of points (border line as a series of points) forming the outline of printed region Car.

The printing color setting unit 515 selects at least one candidate color from the plurality of colors used in the printed region Car obtained by the printed region information obtaining unit 514, and selects the printing color to be printed on the unprinted region Nar detected by the unprinted region detecting unit 513 from the candidate colors and sets the selected color as the printing color.

The candidate colors set by the printing color setting unit 515 are stored in the candidate color register 518.

When the printing color setting unit 515 sets the printing color from the candidate colors, the printing color is stored in the printing color register 519.

When the printing color setting unit 515 selects only one candidate color, the color is set as the printing color and stored in the printing color register 519.

In the embodiment, the printing color setting unit 515 selects a plurality of candidate colors by a plurality of methods, as an example.

The methods for selecting candidate colors from colors of printed region Car by the printing color setting unit 515 are as follows, for example.

(First Method)

As the first method for selecting candidate colors, the printing color setting unit 515 selects out a color used for the largest area (that is, the area of regions in which the color is used is the largest) as the candidate color among the plurality of colors obtained by the printed region information obtaining unit 514 in a case in which the printed region information obtaining unit 514 obtains the plurality of colors used in the printed region Car and obtains areas of regions using the respective colors.

According to the method, the color blending with the entire appearance of nail design already applied to the nail T can be selected as the candidate color.

(Second Method)

As the second method for selecting candidate colors, the printing color setting unit 515 selects out a color most used in a portion near the unprinted region Nar as the candidate color among the colors of printed region Car obtained by the printed region information obtaining unit 514.

Figure 5A:
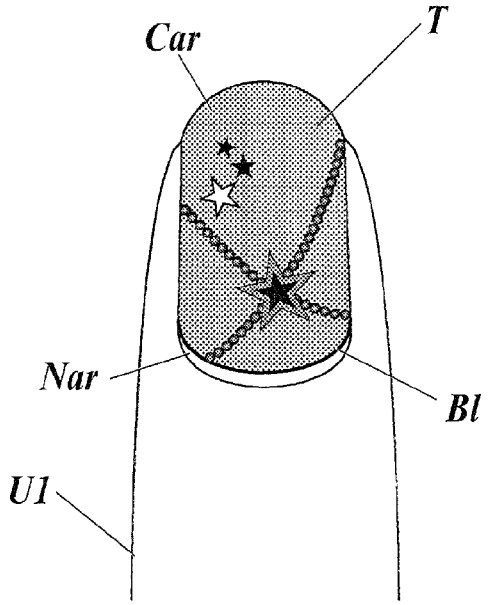
FIG. 5A is a view showing a line adjacent to an unprinted region in a nail.
Figure 5B:
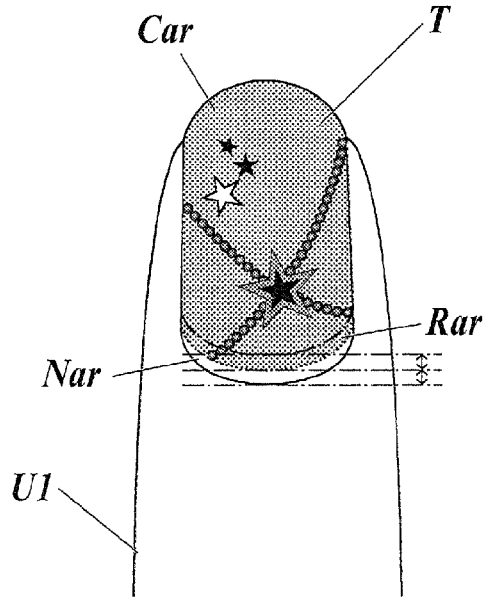
FIG. 5B is a view showing a printing color obtaining region adjacent to the unprinted region in the nail.

FIGS. 5A and 5B are views for explaining the second method which selects out the color most used in the portion near the unprinted region Nar from the colors of printed region Car as the candidate color.

FIG. 5A shows a case in which the border BL of printed region Car adjacent to the unprinted region Nar is selected as the portion near the unprinted region Nar, and the printing color setting unit 515 selects the color most used on the border BL indicated by the thick line in FIG. 5A as the candidate color.

In this case, the border BL indicated by the thick line is a line having a width of one pixel, for example.

According to the method, the main color used at the border BL between the unprinted region Nar and the printed region Car can be selected as the candidate color. Then, when the candidate color is printed on the unprinted region Nar in the nail T, nearly the same color as the border BL between the unprinted region Nar and the printed region Car can be continuously applied onto the unprinted region Nar.

FIG. 5B shows a case in which a predetermined region (hereinafter, called "printing color obtaining region Rar") adjacent to the unprinted region Nar in the printed region Car is selected as the portion near the unprinted region Nar, and the printing color setting unit 515 selects the color most used in the printing color obtaining region Rar as the candidate color.

In this case, which range to set as the printing color obtaining region Rar may be set as default in advance and may be set by the user performing input operation via the operation unit 12 and such like.

In the embodiment, for example, the region between a dashed line and a dashed-dotted line is the printing color obtaining region Rar when the dashed-dotted line in FIG. 5B is obtained by moving the border BL between the unprinted region Nar and the printed region Car indicated by a dashed line in FIG. 5B toward the distal end of nail T for the same distance as the distance from the border HL between the base of nail T and flesh portion of finger to the border BL between the unprinted region Nar and the printed region Car.

According to the method, the main color used on or around the border BL between the unprinted region Nar and the printed region Car can be selected as the candidate color, and when the candidate color is printed on the unprinted region Nar in the nail T, the unprinted region Nar can naturally blend with the printed region Car.

The printing color setting unit 515 stores a plurality of candidate colors selected by the above-mentioned plurality of methods in the candidate color register 518 with the predetermined priority orders.

For example, in the embodiment, the candidate color 1 which is set to be first in the priority order in FIG. 4A is used for the largest area on the border BL between the unprinted region Nar and the printed region Car.

The candidate color 2 which is second in the priority order is used for the largest area in the printing color obtaining region Rar.

The candidate color 3 which is third in the priority order is used for the largest area in the entire printed region Car.

The method for selecting the candidate colors by the printing color setting unit 515 is not limited to the examples illustrated here.

For example, the candidate color may be a color formed of average values of RGB components in the entire printed region Car. The candidate color may be a color formed of average values of RGB components on the border BL which is the border line between the unprinted region Nar and the printed region Car. The candidate color may be a color formed of average values of RGB components of the color used in the printing color obtaining region Rar.

Priority orders may be provided to the candidate colors which are selected by a same method. For example, the color used for the largest area on the border BL between the unprinted region Nar and the printed region Car is first in priority order and the color used for the second largest area is second in priority order.

The number of candidate colors selected by the printing color setting unit 515 is not limited to three. The printing color setting unit 515 may select less than three candidate colors and may select four different candidate colors or more by more methods.

In the embodiment, a plurality of candidate colors selected by the printing color setting unit 515 are displayed on the display unit 13, and the user can input an instruction to print any one of the plurality of candidate colors displayed on the display unit 13 on the unprinted region Nar by operating the operation unit 12.

That is, for example, an image in which each candidate color as a candidate for color to be printed on the unprinted region Nar is printed on the unprinted region Nar is displayed so as to recognize the candidate color in the order of priority, and the printing color confirmation screen (for example, see FIG. 10) to confirm whether to set the candidate color as the printing color is displayed on the display unit 13.

An OK button 121*a* and a color switching button 121*b* are provided on the printing color confirmation screen, for example, and the user operates the OK button 121*a* when setting the displayed candidate color as the color to be printed on the unprinted region Nar.

On the other hand, when the candidate color is to be changed, by operating the color switching button 121*b*, the color on the unprinted region Nar is switched in the order of priority.

The candidate color is displayed in a circulating manner that when all the candidate colors stored in the candidate color register 518 are displayed (that is, every candidate color from the first to last in priority order is displayed in order), the candidate color which is first in the priority order is displayed again.

When the OK button 121*a* is operated, the instruction signal instructing to print the candidate color on the unprinted region Nar is output from the operation unit 12 to the printing color setting unit 515.

Then, the printing color setting unit 515 sets the candidate color approved among the plurality of candidate colors as the printing color to be printed on the unprinted region Nar according to the instruction input from the operation unit 12.

When there is no instruction to print the candidate color input from the operation unit 12, the printing color setting unit 515 reads out the next candidate color from the candidate color register 518 in order and displays the image in which the candidate color is printed on the unprinted region Nar on the display unit 13 until the operation unit 12 inputs the instruction to approve any of the candidate colors.

The printing control unit 516 outputs printing data based on the image data of nail design to the print heads 46 in the printing unit 40 in the nail print mode, and controls the printing unit 40 so as to perform printing on the nail T with the print heads 46 according to the printing data.

In the nail repair mode, the printing control unit 516 controls the print heads 46 to print the printing color set by the printing color setting unit 515 on the unprinted region Nar.

The display control unit 517 controls the display unit 13 to display various display screens.

In the embodiment, the display control unit 517 makes the display unit 13 display a nail image obtained by photographing the printing finger U1, a design selection screen for selecting an image (that is, the nail design) to be printed on the nail T, thumbnail images for design confirmation and instruction screen for displaying various instructions, for example.

The display control unit 517 controls the display unit 13 to display the unprinted region Nar (outline of unprinted region Nar) detected by the unprinted region detecting unit 513 in the nail repair mode. The unprinted region Nar is displayed so as to be clearly confirmed visually by displaying only the unprinted region Nar to be light-colored, or such like.

Furthermore, in the nail repair mode, the display control unit 517 controls the display unit 13 to display a plurality of candidate colors set by the printing color setting unit 515.

Figure 10:
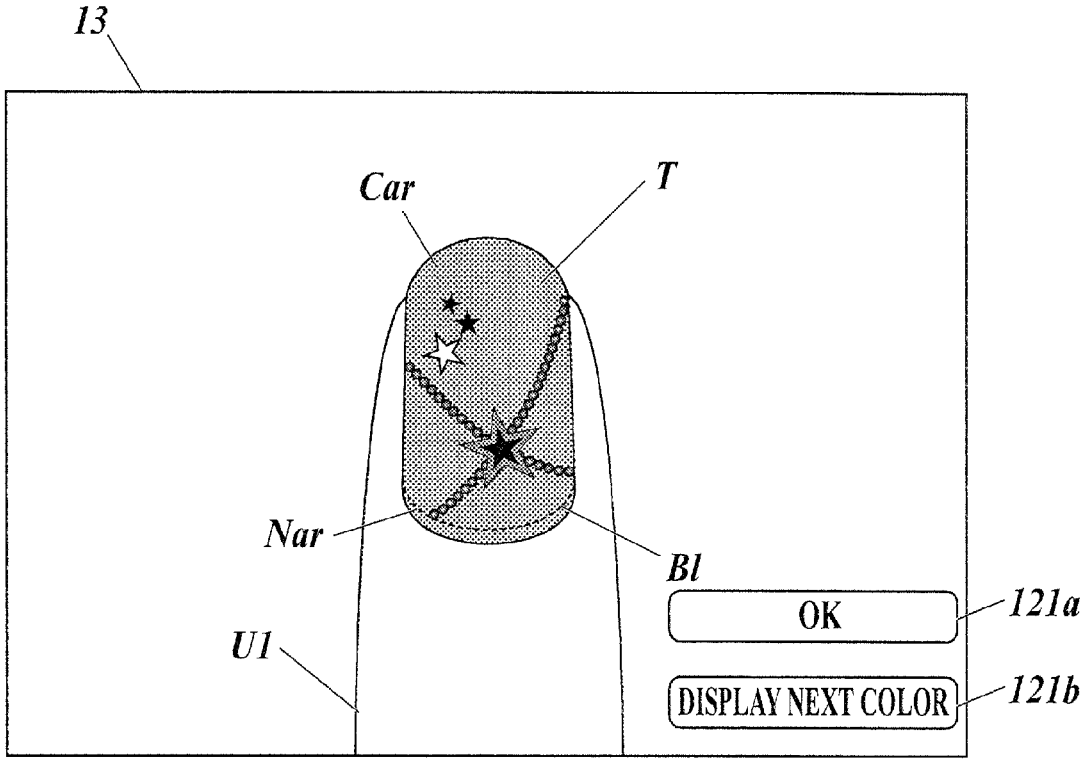
FIG. 10 is a view showing an example of printing color confirmation screen displayed on a display unit.

FIG. 10 is a view showing an example of printing color confirmation screen displayed on the display unit 13.

As shown in FIG. 10, on the printing color confirmation screen, for example, a printing example in which any one of the candidate colors is printed on the unprinted region Nar in the nail T is displayed, and the OK button 121*a* for approving the candidate color as the color to be printed on the unprinted region Nar and the color switching button 121*b* for instructing switching to another candidate color are displayed.

The printing color confirmation screen displayed on the display unit 13 is not limited to the illustrated example as long as the user can recognize the unprinted region Nar and the candidate color which is a candidate for color to be printed thereon.

For example, only the nail T portion may be displayed without displaying the finger portion. Only the unprinted region Nar in the nail T may be displayed.

When the touch panel-type input unit 122 is integrally formed on the display unit 13, a pallet-type list displaying all the candidate colors may be provided around the image of nail T displayed on the display unit 13 so that when the user touches the desired color in the list, the color is reflected as the color of unprinted region Nar in the image of nail T to confirm the candidate color.

Next, with reference to FIGS. 6 to 9, for example, the printing method by the nail print apparatus 1 in the embodiment will be described.

When the nail print apparatus 1 performs printing, the user first turns on the power switch to activate the control device 50 and sets the finger of nail T to be printed into the printing finger inserting unit 20*a*.

Figure 6:
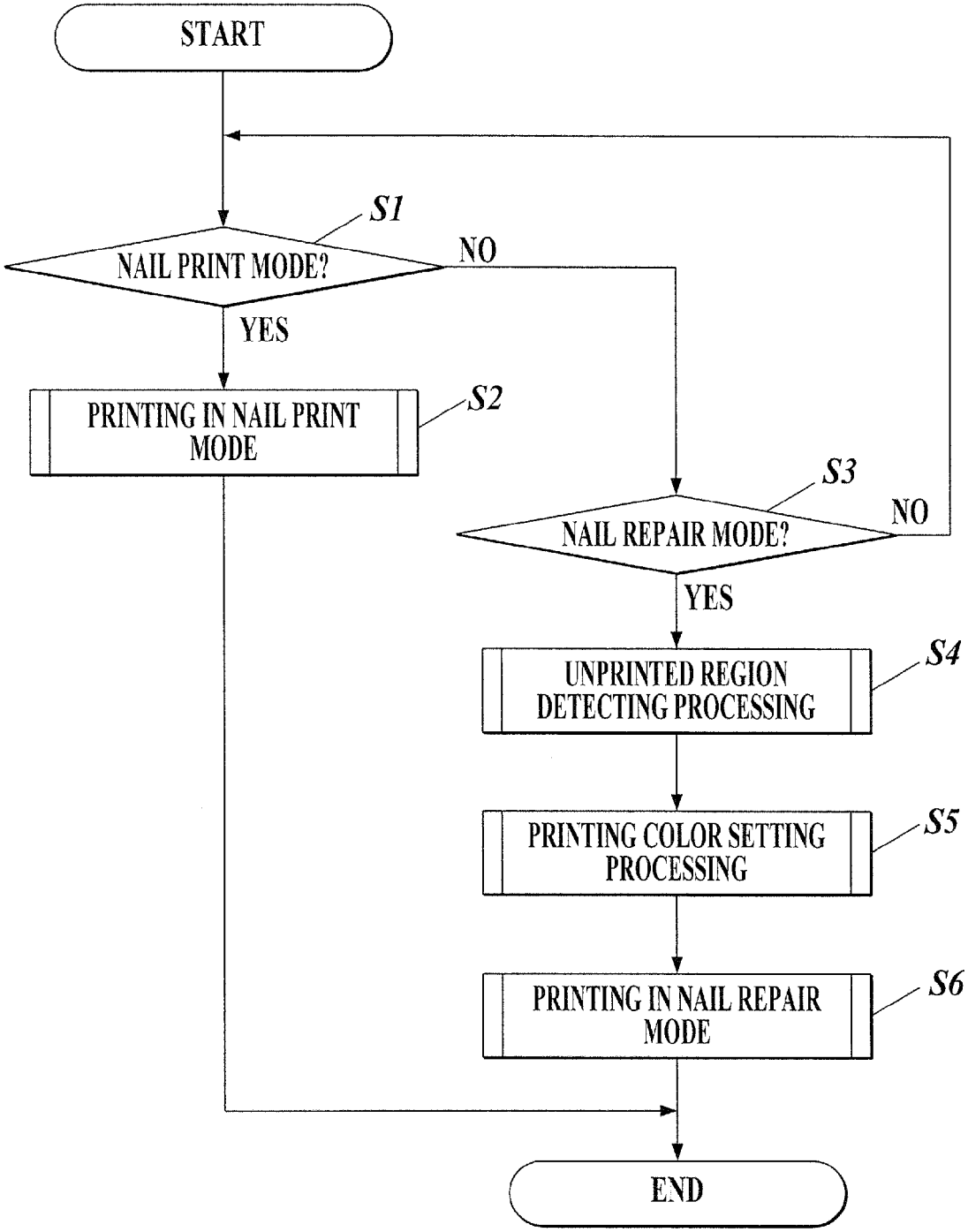
FIG. 6 is a flow chart showing the entire flow of printing processing in the embodiment.

In the nail print apparatus 1 in the embodiment, the nail print mode or the nail repair mode can be selected by the input operation from the operation unit 12 or the like. As shown in FIG. 6, the control unit 51 determines whether the nail print mode is selected (step S1).

If it is determined that the nail print mode is selected (step S1; YES), the nail design is printed in the nail print mode (step S2).

On the other hand, if it is not determined that the nail print mode is selected (step S1; NO), the control unit 51 determines whether the nail repair mode is selected (step S3).

If it is not determined that the nail repair mode is selected (step S3; NO), the processing returns to step S1 and repeats the determination until any instruction is input.

If it is determined that the nail repair mode is selected (step S3; YES), the control unit 51 performs unprinted region detecting processing (step S4) and printing color setting processing (step S5).

When the unprinted region detecting processing (step S4) and the printing color setting processing (step S5) are completed, the printing processing (step 6) in the nail repair mode is performed.

The unprinted region detecting processing (step S4) and the printing color setting processing (step S5) may be performed in the opposite order or in parallel with each other.

Next, with reference to FIG. 7, the specifics of unprinted region detecting processing (step S4) will be described.

Figure 7:
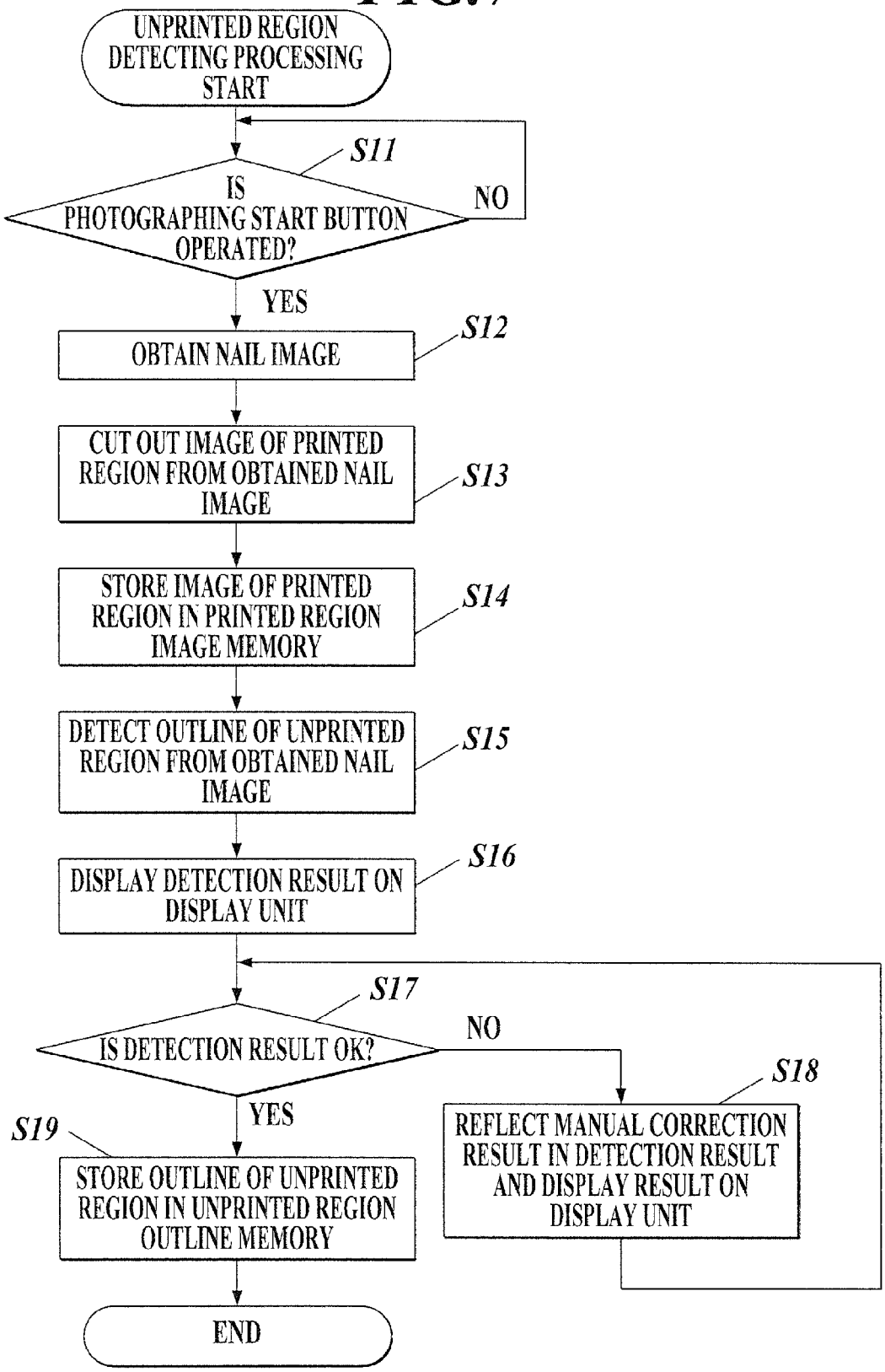
FIG. 7 is a flow chart showing unprinted region detecting processing in FIG. 6.

As shown in FIG. 7, in the unprinted region detecting processing, first, the control unit 51 determines whether the photography start button is operated (step S11).

If it is not determined that the photography start button is operated (step S11; NO), the determination is repeated until the operation is performed.

An instruction screen instructing the user to operate the photography start button may be displayed on the display unit 13.

If it is determined that the photography start button is operated (step S11; YES), the photographing control unit 511 controls the photographing unit 30 to photograph the nail T and obtains the nail image (step S12).

When the photography of nail T ends, the user can remove the printing finger U1 from the printing finger inserting unit 20*a* once to be free.

When the nail image is obtained, the printed region information obtaining unit 514 cuts out the image of printed region Car from the nail image (step S13), and the image of the cut printed region Car is stored in the printed region image memory 523 (step S14).

Next, the unprinted region detecting unit 513 detects the outline of unprinted region Nar from the nail image (step S15).

Then, the outline of the unprinted region Nar which is the detection result is displayed on the display unit 13 (step S16).

The display screen of display unit 13 is provided with the OK button to approve the outline of the unprinted region Nar, for example, and the instruction signal approving the detection result is output by the user operating the OK button or such like.

The unprinted region detecting unit 513 determines whether the detection result (outline of unprinted region Nar) is approved, that is, whether the user operates the OK button or the like (step S17).

If it is determined that the detection result (outline of unprinted region Nar) is approved (step S17; YES), the outline of the unprinted region Nar is stored in the unprinted region outline memory 524 (step S19).

On the other hand, if it is not determined that the detection result (outline of unprinted region Nar) is approved (step S17; NO), the control unit 51 urges the user to manually correct it by displaying the instruction screen on the display unit 13 or the like.

Then, when the manual correction is performed, the corrected result is reflected in the detection result, and displayed on the display unit 13 (step S18).

The processing returns to step S17 to be repeated until the outline of the unprinted region Nar is approved.

Next, with reference to FIG. 8, the specifics of the printing color setting processing (step S5) will be described.

Figure 8:
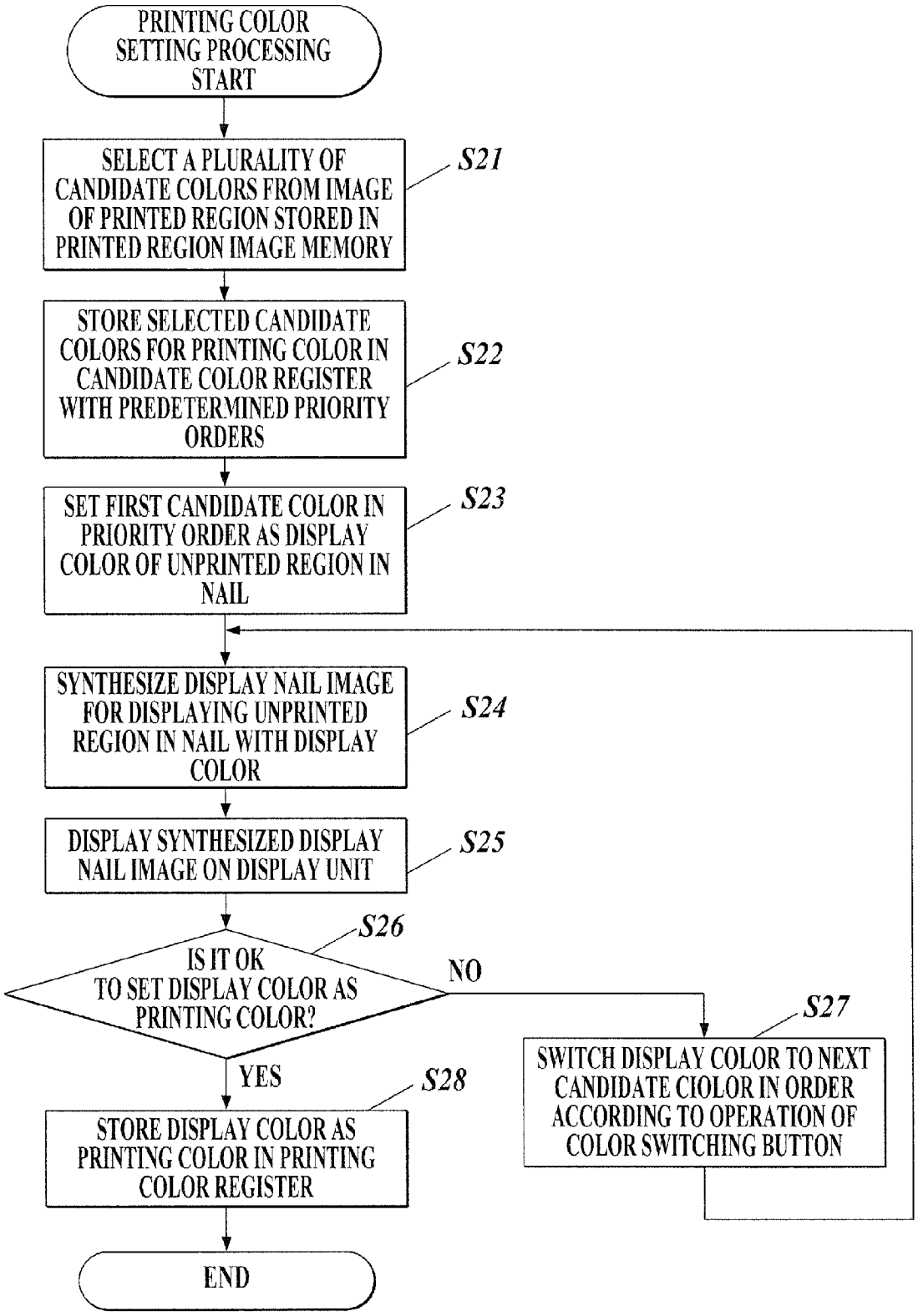
FIG. 8 is a flow chart showing printing color selecting processing in FIG. 6.

As shown in FIG. 8, in the printing color setting processing, the printing color setting unit 515 first selects out a plurality of candidate colors from the image of printed region Car stored in the printed region image memory 523 by any one of the above-mentioned plurality of methods (step S21).

The printing color setting unit 515 provides a predetermined order to the RGB component values representing the selected candidate colors to store the values in the candidate color register 518 (step S22). The selected candidate colors may be stored in the storage unit 52.

Next, the candidate color which is first in priority order is set as the display color of the unprinted region Nar in the nail T (step S23), and a display nail image is composed by displaying the unprinted region Nar in nail T in the display color (candidate color which is first in priority order) (step S24).

The composed display nail image is displayed on the display unit 13 (step S25).

As the display nail image, the entire nail T may be displayed and only the unprinted region Nar in the nail T may be displayed.

The display screen of the display unit 13 is provided with the OK button to approve the display color as the printing color and the color switching button to instruct switching the display color to the next candidate color, for example. By the user operating the OK button, the instruction signal to approve the display color as the printing color is output.

The printing color setting unit 515 determines whether the display color is approved, that is, whether the user operates the OK button or such like (step S26).

If it is determined that the display color is approved (step S26; YES), the display color (candidate color which is first in priority order) is stored in the printing color register 519 (step S28).

On the other hand, if it is not determined that the display color is approved (step S26; NO), that is, if the instruction signal instructing switching of display color (candidate color) is output by the user operating the color switching button, for example, the control unit 51 switches the display color of unprinted region Nar in nail T to the next candidate color in priority order (for example, the candidate color which is second in priority order) (step S27)

The processing returns to step S24 to display the unprinted region Nar in nail T in the display color, and the following processing is repeated until the display color (candidate color) is approved.

Next, with reference to FIG. 9, specifics of printing processing (step S6) in the nail repair mode will be described.

Figure 9:
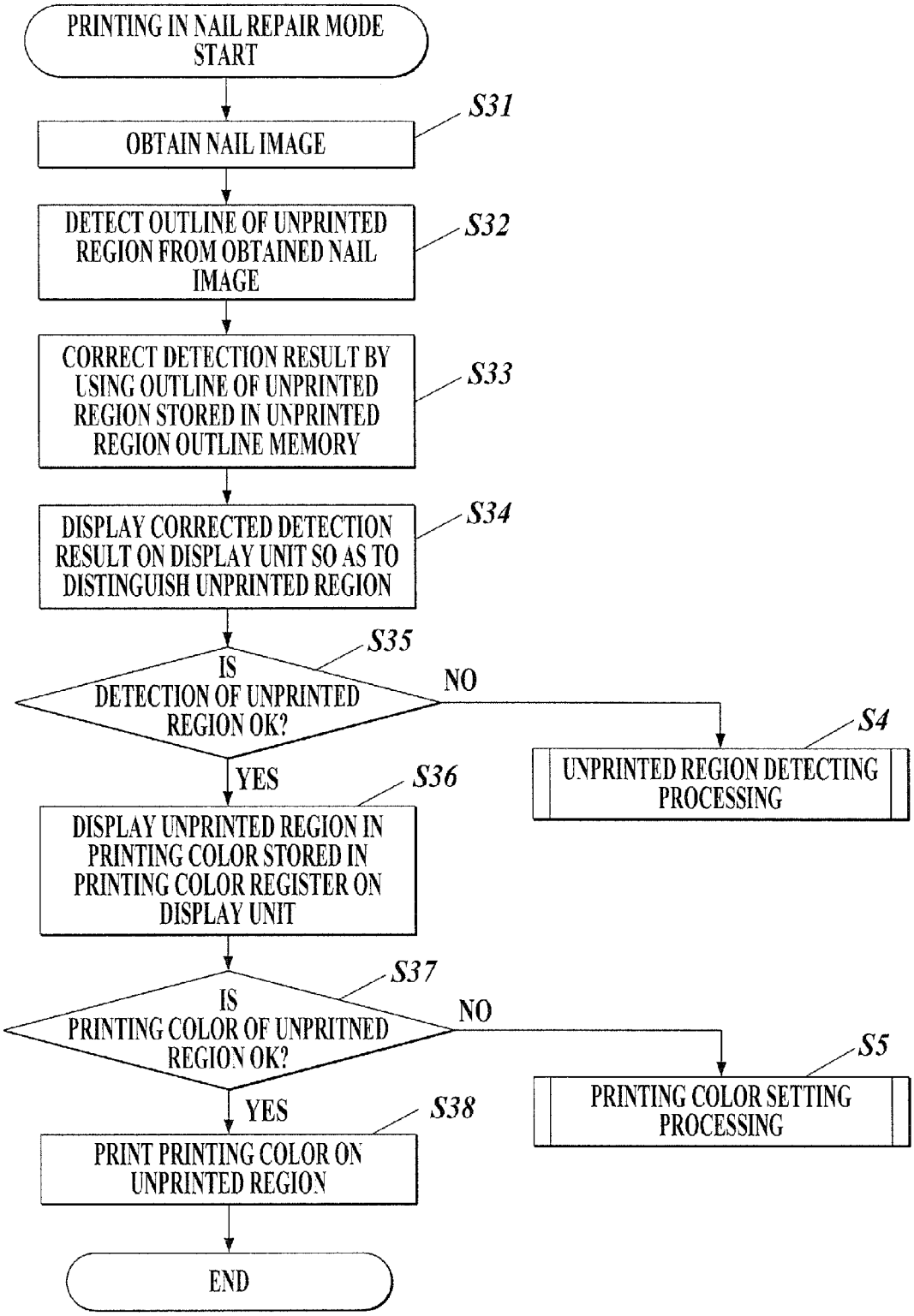
FIG. 9 is a flow chart showing printing processing in a nail repair mode in FIG. 6.

As shown in FIG. 9, in the printing processing in the nail repair mode, the user first sets the printing finger U1 in the printing finger inserting unit 20*a* again.

Then, the photographing control unit 511 controls the photographing unit 30 to obtain the nail image (step S31).

When the nail image is obtained, the unprinted region detecting unit 513 detects the outline of unprinted region Nar from the nail image (step S32).

The unprinted region detecting unit 513 reads out the outline of unprinted region Nar stored in the unprinted region outline memory 524 to perform matching processing or the like between the detected outline and the read outline, and thereby corrects the detection result (step S33).

The detection result after correction is displayed on the display unit 13 in such manner that the unprinted region Nar can be recognized so that the user can recognize which region in nail T is detected as the unprinted region Nar (step S34).

The display screen of display unit 13 is provided with the OK button for approving the detected unprinted region Nar and a redetection button instructing to redo the detection, for example. By the user operating the OK button, an instruction signal approving the unprinted region Nar as the printing range is output.

The control unit 51 determines whether the unprinted region Nar which is the detection result is approved, that is, whether the user operates the OK button or the like (step S35).

If it is not determined that the unprinted region Nar is approved (step S35; NO), that is, if the redetection of unprinted region Nar is instructed by the user operating the redetection button, for example, the processing returns to the unprinted region detecting processing (see FIG. 7) in step S4 of FIG. 6 to perform redetection of unprinted region Nar.

On the other hand, if it is determined that the unprinted region Nar is approved (step S35; YES), the control unit 51 next reads out the printing color from the printing color register and displays the image in which the printing color is on the unprinted region Nar on the display unit (step S36).

The display screen of display unit 13 is provided with the OK button for approving the printing color on the unprinted region Nar and a reselection button for instructing to redo the selection of printing color, for example. By the user operating the OK button, an instruction signal approving the color as the printing color to be printed on the unprinted region Nar is output.

The control unit 51 determines whether the printing color is approved, that is, whether the user operates the OK button or the like (step S37).

If it is not determined that the printing color is approved (step S37; NO), that is, for example, if the reselection of printing color is instructed by the user operating the reselection button, the processing returns to the printing color setting processing (see FIG. 8) in step S5 of FIG. 6 to reselect the printing color.

On the other hand, if it is determined that the printing color is approved (step S37; YES), the printing control unit 516 controls the printing unit 40 to print the printing color on the unprinted region Nar in nail T with the print head 46 (step S38).

As described above, according to the embodiment, when the nail design is already applied to the nail T, the colors of printed region Car are obtained and the unprinted region Nar which is the growing portion in nail T is detected. Then, at least one candidate color is selected from the colors in the printed region Car, and the printing color to be printed on the unprinted region Nar is selected from the candidate colors to be set. The set printing color is printed on the unprinted region Nar.

Thus, it is possible to obscure the unprinted region generated by the growth of nail T and make the nail design printed on the nail T last long.

Such nail print apparatus 1 having a function of nail repair allows a user to enjoy the nail design which lasts long and remains beautiful when the nail design printed on the nail T is favorable or the like, lengthen the interval that the nail is treated at a nail salon or the like, and feel free to select a nail design which will make the growing portion in nail T noticeable when the nail T grows, expanding the range of choices for nail design.

Since an appropriate color can be selected from the colors in the printed region Car to be printed, the selected color can naturally blend with the nail design which is already printed.

Since the unprinted region Nar is detected and printing can be automatically performed in the detected region, only the necessary range is colored to repair the nail design without bothering the user.

In the embodiment, a plurality of selected candidate colors are displayed on the display unit 13, and the user can select any one of the candidate colors as the color to be printed on the unprinted region Nar by operating the operation unit 12. Thus, the color desired by the user can be printed on the unprinted region Nar.

In the embodiment, the printed region information obtaining unit 514 obtains colors of printed region Car and areas of regions on which respective colors are used, and the printing color setting unit 515 selects the color used for the largest area as the candidate color from among the colors which are already obtained by the printed region information obtaining unit 514. Thus, the color which fits to the entire appearance of nail design already printed on the nail T can be the candidate color for the printing color.

In the embodiment, the printing color setting unit 515 selects, as the candidate color, the color most used on the portion near the unprinted region Nar (for example, the line of border BL between the unprinted region Nar and the printed region Car and a predetermined printing color obtaining region Rar adjacent to the unprinted region Nar) among the colors of printed region Car obtained by the printed region information obtaining unit 514.

Thus, it is possible to select, as the candidate color, the main color used on and near the border BL between the unprinted region Nar and the printed region Car, and when the candidate color is printed on the unprinted region Nar in the nail T, the unprinted region Nar can be naturally fitted into the printed region Car.

Though the embodiment of the present invention has been described as described above, the present invention is not limited to the embodiment, and various changes can be made within the scope of the invention.

For example, in the embodiment, the print heads 46 are ink jet type print heads. However, the print heads 46 are not limited to the ink jet type and may use a pen such as a ballpoint pen and a felt pen to directly contact the nail T and perform drawing, for example.

In such case, the printing unit includes a print head including pens for drawing and a moving mechanism for moving the print head in the X direction and the Y direction, for example.

The print head may be provided with a plurality of pens which has different colors or may be provided with only a pen with a single color. It is preferable that the pens can be replaced by a user.

Each of the pens has a pen tip at the distal end of the pen shaft, for example. When printing is performed, the height of pen is controlled so that the pen tip contacts the nail T. Then, the print head is moved by the moving mechanism on the basis of the printing data, and thereby the pen moves to draw an image on the nail T. Also in this case, the same effect can be obtained as in the embodiment.

In the embodiment, the unprinted region detecting unit 513 detects the unprinted region Nar from the nail image automatically; however, the method for cutting out the unprinted region Nar is not limited to this.

For example, the nail image may be displayed on the display unit 13 so that the user can manually input the range of unprinted region Nar by specifying the outline of unprinted region Nar with touch operation and the unprinted region detecting unit 513 may cut out the input region as the unprinted region Nar.

The outline of unprinted region Nar detected by the unprinted region detecting unit 513 may be stored in the storage unit 52 with the type of finger and such like so as to use the information of unprinted region Nar stored in the storage unit 52 when printing is performed on the same finger again in the nail repair mode.

Since the nail T grows similarly at a constant pace, when the same days have passed from the printing of nail design, the nearly same unprinted region Nar is generated at the growing portion of nail T. Thus, by storing the unprinted region Nar which was detected once, the unprinted region Nar can be detected promptly and accurately on the basis of the stored information and the prompt processing can be achieved at the following printing.

In the embodiment, as an example, the control unit 51 includes the candidate color register 518 and printing color register 519, and various types of processing is performed while candidate colors and printing color are temporarily stored in the registers in the control unit 51; however, the position to store the candidate colors and the printing color is not limited to them.

For example, the storage unit 52 may be provided with a storage area to store the candidate colors and the printing color to store the selected candidate colors and the printing color.

Storing the candidate colors once selected out by the printing color setting unit and the set printing color in the storage unit 52 or the like makes it possible to perform the second or following printing color setting processing promptly by, for example, reading out the same color as the previous color as the candidate color or the printing color when the nail T printed in the nail repair mode has grown again to need repair of nail design.

In the embodiment, even after the printing processing is started in the nail repair mode, the unprinted region Nar is confirmed (step S35 in FIG. 9) and the printing color is confirmed (step S37 in FIG. 9); however, when printing processing is performed after the unprinted region detecting processing and the printing color setting processing, the printing operation may be started immediately without performing the above confirmation processing.

When the printing color is confirmed (step S37 in FIG. 9), the unprinted region Nar may also be confirmed without performing the confirmation (step S35 in FIG. 9) of only the unprinted region Nar.

In the embodiment, as an example, the printing color setting unit 515 extracts the candidate colors to store them in the candidate color register 518, the candidate colors are displayed on the display unit in order, and thereby the user selects one of them; however, the method for showing the candidate colors to the user is not limited to this.

For example, the printing color setting unit 515 may select all the colors used in the printed region Car obtained by the printed region information obtaining unit 514 as the candidate colors and display them on the display unit 13 so that the user selects one of them.

In this case, for example, the color to be the printing color is input by displaying the image of nail T having the nail design printed on the display unit 13 and the user touches the screen at the portion of the color to be printed on the unprinted region Nar.

The color to be the printing color may be input by displaying a list like a pallet of all the colors used in the printed region Car on the display screen so that the user touches the color to be printed on the unprinted region Nar among the colors.

In the embodiment, as an example, the touch panel-type input unit 122 is provided so as to be superposed on the display unit 13, and by the direct touch operation using a pen or the like, input for correcting the outline of unprinted region Nar and setting of printing color can be performed; however, the method for performing input operation is not limited to this.

For example, the user may use a pointing device such as a mouse to perform input for correcting the outline of unprinted region Nar and setting the printing color while looking at the display screen of display unit 13. In such case, the touch panel-type input unit 122 is not essential.

The embodiment takes, as an example, the nail print apparatus 1 which can selectively perform printing in the normal nail print mode and printing in the nail repair mode for repairing nail design; however, the nail print apparatus 1 is not limited to this, and may be dedicated for the printing in the nail repair mode. In such case, the shape (outline) of the entire nail T needs not be recognized. The design data memory 522 or the like for storing nail design is not necessary, either.

In the embodiment, as an example, the program memory 521, the design data memory 522, the printed region image memory 523 and the unprinted region outline memory 524 are provided in the storage unit 52 in the control device 50; however, the place to provide the program memory 521, the design data memory 522, the printed region image memory 523 and the unprinted region outline memory 524 is not limited to the storage unit 52 (ROM and RAM) in the control device 50, and another storage unit may be provided.

In the embodiment, as an example, fingers are inserted into the nail print apparatus 1 one by one to perform printing in order; however, the present invention can be applied to an apparatus which can continuously perform printing on the fingers by inserting four fingers at the same time.

Though several embodiments of the present invention have been described above, the scope of the present invention is not limited to the above embodiments, and includes the scope of inventions, which is described in the scope of claims, and the scope equivalent thereof.

What is claimed is:

1. A nail print apparatus, comprising:

a placement surface on which a finger or a toe is placed;

a print head which performs printing on a surface of a nail of the finger or the toe, the surface of the nail corresponding to a surface side that is opposite a side contacting the placement surface;

an unprinted region detecting unit which detects an unprinted region on the surface of the nail based on an image obtained by photographing the nail from the surface side, the surface of the nail including a printed region on which a nail design is printed and the unprinted region on which the nail design is not printed and generated by growth of the nail after the nail design is printed; and a printing control unit which controls the print head to perform printing on the unprinted region.

2. The nail print apparatus according to claim 1, wherein the unprinted region detecting unit detects, as the unprinted region, a region which is a growing portion of the nail and on which the nail design is not printed.

3. The nail print apparatus according to claim 1, further comprising, a printed region information obtaining unit which obtains, as color information, information of a color used in the printed region in the nail; and a printing color setting unit which sets a printing color to be printed on the unprinted region, wherein the printing color setting unit sets the printing color on basis of the color information obtained by the printed region information obtaining unit.

4. The nail print apparatus according to claim 3, further comprising a nail outline detecting unit which detects, as a first outline, an outline of the nail, wherein the printed region information obtaining unit detects, as a second outline, an outline of the printed region, and the unprinted region detecting unit detects, as the unprinted region, a region excluding a region defined by the second outline from a region defined by the first outline.

5. The nail print apparatus according to claim 3, further comprising, a display unit which displays a plurality of candidate colors according to a priority order; and an operation unit which inputs and instructs to set any one of the plurality of candidate colors displayed on the display unit as the printing color, wherein the printed region information obtaining unit obtains a plurality of colors used in the printed region as the color information when the nail design has the plurality of colors, the printing color setting unit obtains the plurality of colors obtained by the printed region information obtaining unit as the plurality of candidate colors and sets the priority order with respect to the obtained plurality of candidate colors, the priority order corresponding to an order of ease of blending with the colors of the printed region, and the printing color setting unit sets, as the printing color, a specific candidate color among the plurality of candidate colors which is input to be the printing color by the operation unit.

6. The nail print apparatus according to claim 5, wherein the printing color setting unit sets each of the plurality of candidate colors as a display color according to the priority order and generates a display nail image in which the unprinted region is colored in the display color, and the display unit displays the display nail image.

7. The nail print apparatus according to claim 5, wherein the printed region information obtaining unit obtains, as the color information, areas of respective regions using each of the plurality of colors in the printed region, and the printing color setting unit sets the priority order of the plurality of colors on basis of the areas using the colors obtained by the printed region information obtaining unit.

8. The nail print apparatus according to claim 5, wherein the printed region information obtaining unit obtains, as the color information, a first color which is most used on a border between the unprinted region and the printed region, a second color which is most used in a region near the unprinted region, and a third color which is used for a largest area in the printed region, and the printing color setting unit sets the priority order of the first color to a first value, the priority order of the second color to a second value which is a priority lower than the first value, and the priority order of the third color to a third value which is a priority lower than the second value.

9. A printing method of a nail print apparatus including a placement surface on which a finger or a toe is placed, the method comprising:

detecting an unprinted region on a surface of the nail of the finger or the toe based on an image obtained by photographing the nail from a surface side of the nail that is opposite a side contacting the placement surface, the surface of the nail including a printed region on which a nail design is printed and the unprinted region on which the nail design is not printed and generated by growth of the nail after the nail design is printed; and printing on the unprinted region.

10. The printing method of the nail print apparatus according to claim 9, wherein, in the detecting of the unprinted region, a region which is a growing portion of the nail and on which the nail design is not printed is detected as the unprinted region.

11. The printing method of the nail print apparatus according to claim 9, further comprising, obtaining, as color information, information of a color used in the printed region in the nail; and setting a printing color to be printed on the unprinted region, wherein in the setting of the printing color, the printing color is set on basis of the obtained color information.

12. The printing method of the nail print apparatus according to claim 11, further comprising detecting, as a first outline, an outline of the nail, wherein the obtaining of the color information includes detecting, as a second outline, an outline of the printed region, and in the detecting of the unprinted region, a region excluding a region defined by the second outline from a region defined by the first outline is detected as the unprinted region.

13. The printing method of the nail print apparatus according to claim 11, wherein in the obtaining of the color information, a plurality of colors used in the printed region are obtained as the color information when the nail design has the plurality of colors, and in the setting of the printing color, the plurality of colors obtained in the obtaining of the color information are obtained as a plurality of candidate colors and a priority order is set with respect to the plurality of candidate colors, the priority order corresponding to an order of ease of blending with the colors of the printed region, the plurality of candidate colors are displayed on a display unit according to the priority order; and among the plurality of candidate colors displayed on the display unit, a specific candidate color which is input and instructed to be the printing color is set to be the printing color.

14. The printing method of the nail print apparatus according to claim 13, wherein in the setting of the printing color, each of the plurality of candidate colors is set as a display color according to the priority order and a display nail image in which the unprinted region is colored in the display color is generated, and the display nail image is displayed on the display unit.

15. The printing method of the nail print apparatus according to claim 11, wherein the obtaining of the color information includes obtaining, as the color information, areas of respective regions using a plurality of colors in the printed region, and in the setting of the printing color, a priority order with respect to the obtained plurality of colors is set so that a color used for a larger area has a higher priority.

16. The printing method of the nail print apparatus according to claim 11, wherein the obtaining of the color information includes obtaining, as the color information, a first color which is most used on a border between the unprinted region and the printed region, a second color which is most used in a region near the unprinted region, and a third color which is used for a largest area in the printed region, and in the setting of the printing color, the priority order of the first color is set to a first value, the priority order of the second color is set to a second value which is a priority lower than the first value, and the priority order of the third color is set to a third value which is a priority lower than the second value.

* * * * *